US008616338B2

(12) United States Patent
Veronesi et al.

(10) Patent No.: US 8,616,338 B2
(45) Date of Patent: Dec. 31, 2013

(54) MANAGEMENT OF POWER FROM MULTIPLE SOURCES BASED ON ELEVATOR USAGE PATTERNS

(75) Inventors: William A. Veronesi, Hartford, CT (US); Stella M. Oggianu, Manchester, CT (US)

(73) Assignee: Otis Elevator Company, Farmington, CT (US)

( * ) Notice: Subject to any disclaimer, the term of this patent is extended or adjusted under 35 U.S.C. 154(b) by 435 days.

(21) Appl. No.: 13/059,535

(22) PCT Filed: Sep. 4, 2008

(86) PCT No.: PCT/US2008/010381

§ 371 (c)(1), (2), (4) Date: Feb. 17, 2011

(87) PCT Pub. No.: WO2010/027346

PCT Pub. Date: Mar. 11, 2010

(65) Prior Publication Data

US 2011/0139547 A1 Jun. 16, 2011

(51) Int. Cl.
*B66B 1/06* (2006.01)

(52) U.S. Cl.
USPC ..... 187/290; 187/391

(58) Field of Classification Search
USPC ..... 187/289, 290, 293, 295, 296, 297, 187/391–393; 318/375, 376, 799–815
See application file for complete search history.

(56) References Cited

U.S. PATENT DOCUMENTS 4,456,097 A * 6/1984 Salihi ..... 187/289
5,896,948 A * 4/1999 Suur-Askola et al. ..... 187/290
6,264,005 B1 * 7/2001 Kang et al. ..... 187/290
6,315,081 B1 * 11/2001 Yeo ..... 187/290
6,431,323 B2 8/2002 Tajima et al.
6,471,013 B2 * 10/2002 Banno et al. ..... 187/290
6,474,447 B2 * 11/2002 Tajima et al. ..... 187/290
6,938,733 B2 * 9/2005 Eilinger ..... 187/290
7,554,278 B2 * 6/2009 Wegner-Donnelly et al. ..... 318/375
7,594,564 B2 * 9/2009 Siikonen et al. ..... 187/384

(Continued)

FOREIGN PATENT DOCUMENTS

CN 1301662 A 7/2001
CN 1301663 A 7/2001

(Continued)

OTHER PUBLICATIONS

Office Action of the Korean Patent Office in application No. 10-2011-7007745, dated Sep. 13, 2012.

(Continued)

*Primary Examiner* — Anthony Salata
(74) *Attorney, Agent, or Firm* — Kinney & Lange, P.A.

(57) ABSTRACT

Power distribution is managed in an elevator system including an elevator hoist motor (12), a primary power supply (20), and—an energy storage system (32). A predicted usage pattern for the hoist motor is established based on past hoist motor power demand in the elevator system or in similar elevator systems in similar buildings. A target storage state for the energy storage system is then set based on the predicted usage pattern. Power exchanged between the hoist motor, the primary power supply, and the energy storage system is controlled to address power demand of the hoist motor and to maintain the storage state of the energy storage system at about the target storage state.

20 Claims, 3 Drawing Sheets

(56) References Cited

U.S. PATENT DOCUMENTS

| | | | | |
|---|---|---|---|---|
| 7,681,694 | B2 * | 3/2010 | Aulanko et al. | 187/290 |
| 8,172,042 | B2 * | 5/2012 | Wesson et al. | 187/382 |
| 2001/0011618 | A1 | 8/2001 | Tajima et al. | |
| 2011/0226559 | A1 * | 9/2011 | Chen et al. | 187/290 |

FOREIGN PATENT DOCUMENTS

| | | | |
|---|---|---|---|
| CN | 1311150 | A | 9/2001 |
| CN | 1311151 | A | 9/2001 |
| GB | 2106730 | A | 4/1983 |
| JP | 09227033 | A | 9/1997 |
| JP | 2001187676 | A | 7/2001 |
| JP | 2005324884 | A | 11/2005 |
| JP | 2005343574 | A | 12/2005 |
| JP | 2006321640 | A | 11/2006 |
| KR | 20010062811 | A | 7/2001 |
| WO | WO 2010020705 | A1 * | 2/2010 |

OTHER PUBLICATIONS

Office Action of the Russian Federal Institute of Industrial Property in application No. 2011107074/11, dated Aug. 22, 2012.

Office Action of the Japanese Patent Office in application No. 2011-526018, dated Nov. 29, 2012.

Official Search Report and Written Opinion of the Patent Cooperation Treaty Office in foreign counterpart Application No. PCT/US2008/010381, filed Sep. 4, 2008.

State Intellectual Property Office of People'S Republic China, Search Report, Mar. 12, 2013, 3 pages.

State Intellectual Property Office, P.R. China, First Office Action, Apr. 2, 2013, 12 pages.

State Intellectual Property Office, P.R. China, First Office Action Official Form, Apr. 2, 2013, 4 pages.

Japanese Patent Office, Office Action, Sep. 10, 2013, 5 pages.

* cited by examiner

MANAGEMENT OF POWER FROM MULTIPLE SOURCES BASED ON ELEVATOR USAGE PATTERNS

BACKGROUND

The present invention relates to power systems. More specifically, the present invention relates to a system for managing power in an elevator system from multiple sources based on elevator usage patterns.

Power demand for operating elevators range from positive, in which externally generated power (such as from a power utility) is used, to negative, in which the load in the elevator drives the motor so it produces electricity as a generator. The use of the motor to produce electricity as a generator is commonly called regeneration. In conventional systems, if the regenerated energy is not provided to another component of the elevator system or returned to the utility grid, it is dissipated through a dynamic brake resistor or other electrical load. In this configuration, all demand remains on the power utility to supply power to the elevator system, even during peak power conditions (e.g., when more than one motor starts simultaneously or during periods of high demand). Thus, components of the elevator system that deliver power from the power utility need to be sized to accommodate power demand, which may be more costly and require more space. Also, the regenerated energy that is dissipated is not used, thereby decreasing the efficiency of the power system.

In addition, an elevator drive system is typically designed to operate over a specific input voltage range from a power supply. The components of the drive have voltage and current ratings that allow the drive to continuously operate while the power supply remains within the designated input voltage range. In conventional systems, when the utility voltage sags beyond design limits, the elevator system faults. When a utility power failure occurs or under poor quality conditions in conventional systems, the elevator may become stalled between floors in the elevator hoistway until the power supply returns to normal operation or a mechanic intervenes.

SUMMARY

The present invention relates to managing energy in an elevator system including an elevator hoist motor, a primary power supply, and an energy storage system. A predicted usage pattern for the hoist motor is established based on past hoist motor power demand in the elevator system or in elevator systems in similar buildings. A target state of stored energy (or storage state) for the energy storage system is then set based on the predicted usage pattern. Power exchanged between the hoist motor, the primary power supply, and the energy storage system is controlled to address power demand of the hoist motor and to maintain the storage state of the energy storage system at about the target storage state.

DETAILED DESCRIPTION

Figure 1:
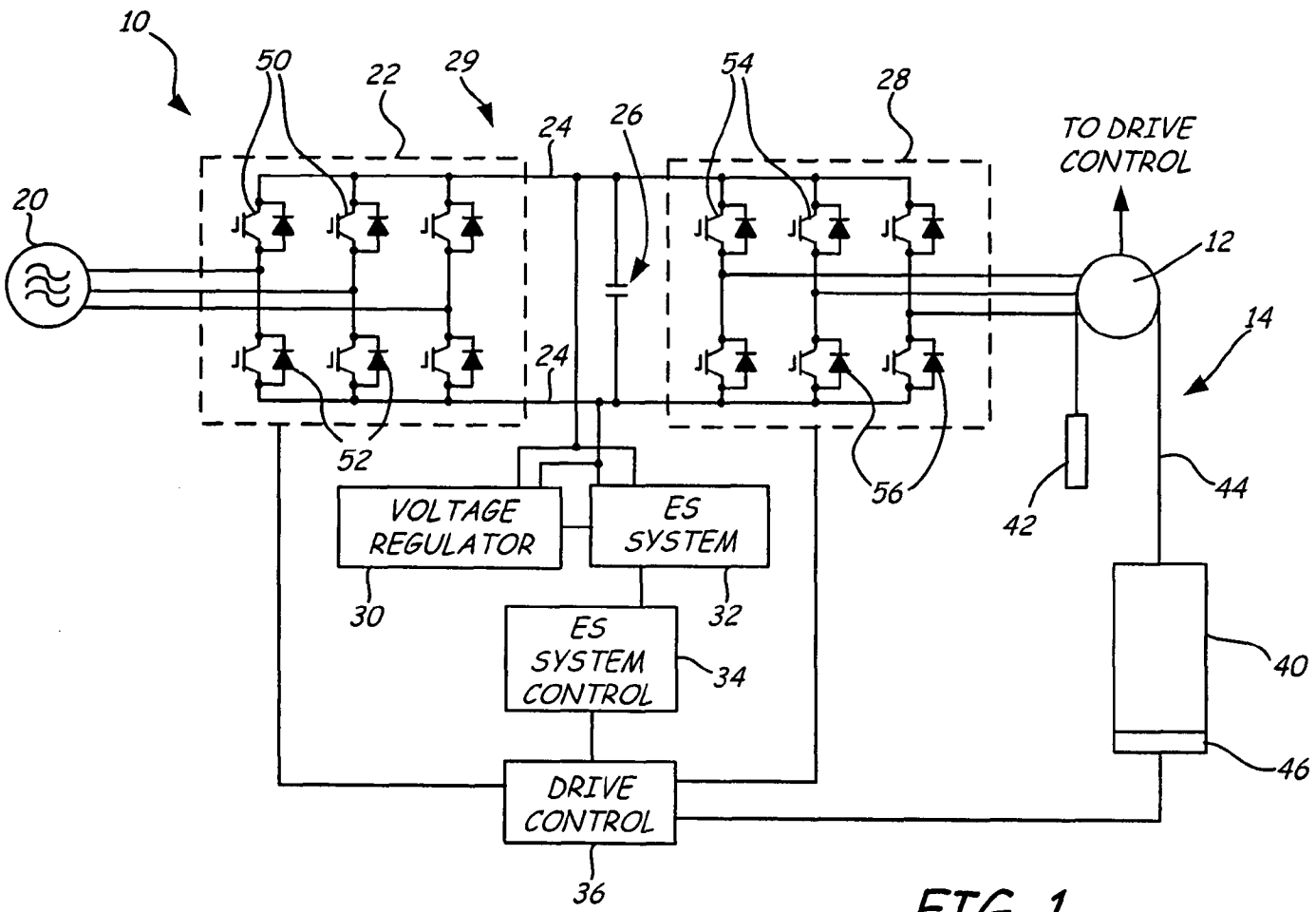
FIG. 1 is a schematic view of an elevator power system including a controller for managing power from multiple sources.

FIG. 1 is a schematic view of power system 10 including primary power supply 20, power converter 22, power bus 24, smoothing capacitor 26, power inverter 28, voltage regulator 30, electrical or mechanical energy storage (ES) system 32, ES system controller 34, and drive controller 36. Power converter 22, DC bus 24, smoothing capacitor 26, and power inverter 28 are included in regenerative drive 29. Primary power supply 20 may be an electrical utility power distribution grid. ES system 32 includes a device or a plurality of devices capable of storing electrical or mechanical energy. Elevator 14 includes elevator car 40 and counterweight 42 that are connected through roping 44 to hoist motor 12. Elevator 14 also includes load sensor 46, connected to drive controller 36, for measuring the weight of the load in elevator car 40.

As will be described herein, power system 10 is configured to control power exchanged between elevator hoist motor 12, primary power supply 20, and/or ES system 32 to address power demand of hoist motor 12 and maintain the storage state of ES system 32 at about a target level. The target storage state is set based on usage patterns of elevator hoist motor 12 as well as other factors such as specifications for minimum and maximum grid usage. The usage patterns may be established by hoist motor power demand during previous use of power system 10, by hoist motor power demand in elevator systems in similar buildings, or a combination of both. For example, when power demand of elevator hoist motor 12 is positive, power system 10 drives hoist motor 12 from primary power supply 20 and ES system 32 in a ratio that maintains the storage state of ES system 32 at about the target level. As another example, when power demand of elevator hoist motor 12 is negative, power system 10 provides the power generated by elevator hoist motor 12 to power supply 20 and ES system 32 in a ratio that increases the storage state of ES system 32 back to about the target storage state. The ratio of power supplied by or returned to ES system 32 may be a function of the proximity of the storage state of ES system 32 to the target storage state. Power system 10 also controls distribution of power between primary power supply 20 and ES system 32 when the power demand of elevator hoist motor 12 is approximately zero, and between ES system 32 and elevator hoist motor 12 in the event of failure of primary power supply 20.

Power converter 22 and power inverter 28 are connected by DC bus 24. Smoothing capacitor 26 is connected across DC bus 24. Primary power supply 20 provides electrical power to power converter 22. Power converter 22 is a three-phase power inverter that is operable to convert three-phase AC power from primary power supply 20 to DC power. In one embodiment, power converter 22 comprises a plurality of power transistor circuits including parallel-connected transistors 50 and diodes 52. Each transistor 50 may be, for example, an insulated gate bipolar transistor (IGBT). The controlled electrode (i.e., gate or base) of each transistor 50 is connected to drive controller 36. Drive controller 36 controls the power transistor circuits to convert the three-phase AC power from primary power supply 20 to DC output power. The DC output power is provided by power converter 22 on DC bus 24. Smoothing capacitor 26 smoothes the rectified power provided by power converter 22 on DC bus 24. It is important to note that while primary power supply 20 is shown as a three-phase AC power supply, power system 10 may be adapted to receive power from any type of power source, including (but not limited to) a single phase AC power source and a DC power source.

The power transistor circuits of power converter 22 also allow power on DC bus 24 to be inverted and provided to primary power supply 20. In one embodiment, drive controller 36 employs pulse width modulation (PWM) to produce gating pulses so as to periodically switch transistors 50 of power converter 22 to provide a three-phase AC power signal to primary power supply 20. With other loads on primary power supply 20, this regenerative configuration reduces the demand on primary power supply 20.

Power inverter 28 is a three-phase power inverter that is operable to invert DC power from DC bus 24 to three-phase AC power. Power inverter 28 comprises a plurality of power transistor circuits including parallel-connected transistors 54 and diodes 56. Each transistor 54 may be, for example, an insulated gate bipolar transistor (IGBT). The controlled electrode (i.e., gate or base) of each transistor 54 is connected to drive controller 36, which controls the power transistor circuits to invert the DC power on DC bus 24 to three-phase AC output power. The three-phase AC power at the outputs of power inverter 28 is provided to hoist motor 12. In one embodiment, drive controller 36 employs PWM to produce gating pulses to periodically switch transistors 54 of power inverter 28 to provide a three-phase AC power signal to hoist motor 12. Drive controller 36 may vary the speed and direction of movement of elevator 14 by adjusting the frequency and duration of the gating pulses to transistors 54.

In addition, the power transistor circuits of power inverter 54 are operable to rectify power that is generated when elevator 14 drives hoist motor 12. For example, if hoist motor 12 is generating power, drive controller 36 controls transistors 54 in power inverter 28 to allow the generated power to be converted and provided to DC bus 24. Smoothing capacitor 26 smoothes the converted power provided by power inverter 28 on DC bus 24. The regenerated power on DC bus 24 may be used to recharge the storage elements of ES system 32, may be returned to primary power supply 20 as described above, or may be dissipated in a dynamic braking resistor (not shown).

Hoist motor 12 controls the speed and direction of movement between elevator car 40 and counterweight 42. The power required to drive hoist motor 12 varies with the acceleration and direction of elevator 14, as well as the load in elevator car 40. For example, if elevator car 40 is being accelerated, run up with a load greater than the weight of counterweight 42 (i.e., heavy load), or run down with a load less than the weight of counterweight 42 (i.e., light load), a maximal amount of power is required to drive hoist motor 12. In this case, the power demand for hoist motor 12 is positive. If elevator car 40 runs down with a heavy load, or runs up with a light load, elevator car 40 drives hoist motor 12, regenerating energy. In this case of negative power demand, hoist motor 12 generates three-phase AC power that is converted to DC power by power inverter 28 under the control of drive controller 36. As described above, the converted DC power may be returned to primary power supply 20, used to recharge ES system 32, and/or dissipated in a dynamic brake resistor connected across DC bus 24. If elevator 14 is leveling or running at a fixed speed with a balanced load, it may be using a lesser amount of power. If hoist motor 12 is neither motoring nor generating power (i.e. idle), the power demand of hoist motor 12 is approximately zero.

It should be noted that while a single hoist motor 12 is shown connected to power system 10, power system 10 can be modified to power multiple hoist motors 12. For example, a plurality of power inverters 28 may be connected in parallel across DC bus 24 to provide power to a plurality of hoist motors 12. In addition, while ES system 32 is shown connected to DC bus 24, ES system 32 may alternatively be connected to one phase of the three phase input of power converter 22.

ES system 32 may include one or more devices capable of storing electrical energy that are connected in series or parallel. When ES system 32 stores electrical energy, the storage state may be referred to as a state-of-charge (SOC). In some embodiments, ES system 32 includes at least one supercapacitor, which may include symmetric or asymmetric supercapacitors. In other embodiments, ES system 32 includes at least one secondary or rechargeable battery, which may include any of nickel-cadmium (NiCd), lead acid, nickel-metal hydride (NiMH), lithium ion (Li-ion), lithium ion polymer (Li-Poly), iron electrode, nickel-zinc, zinc/alkaline/manganese dioxide, zinc-bromine flow, vanadium flow, and sodium-sulfur batteries.

In other embodiments, ES system 32 is a mechanical energy storage system. For example, mechanical devices such as flywheels may be used to store kinetic energy.

Figure 2:
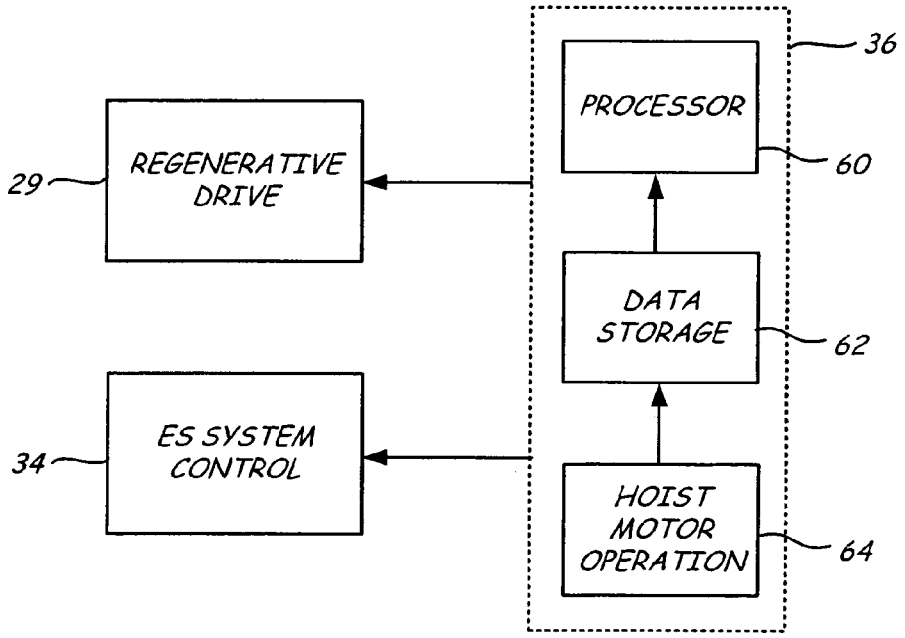
FIG. 2 is a block diagram of a drive controller for controlling power distribution to components of the elevator system based on a target storage state of an energy storage system.

FIG. 2 is a block diagram of drive controller 36, which is connected to regenerative drive 29 and ES system controller 34. Drive controller 36 includes processor 60, data storage module 62, and hoist motor operation module 64. Drive controller 36 may also include other components not specifically depicted in FIG. 2. Hoist motor operation module 64 provides an input to data storage module 62, which provides an input to processor 60. Based on the input from data storage module 62, processor 60 generates signals that control operation of regenerative drive 29 and ES system controller 34.

Figure 3:
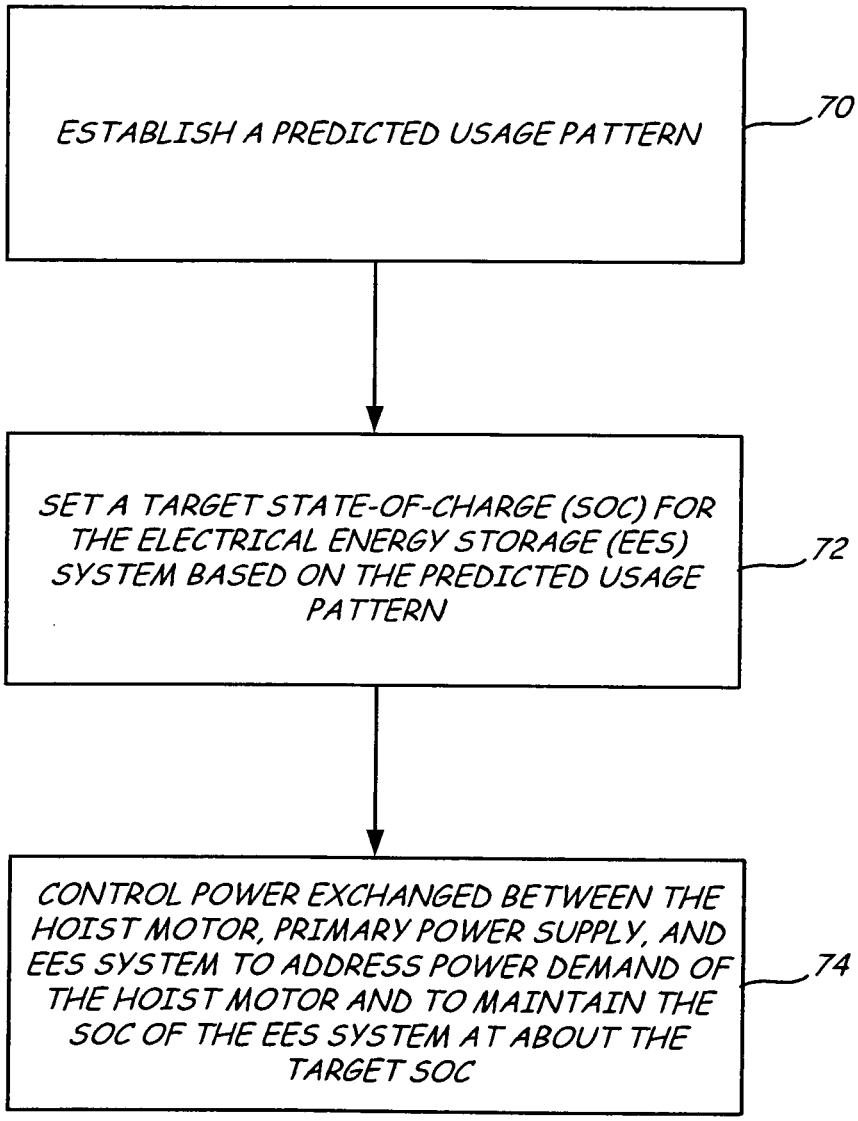
FIG. 3 is a flow diagram of a process for managing power exchanged between a hoist motor, primary power supply, and energy storage system based on the target storage state.

FIG. 3 is a flow diagram of a process for managing power exchanged between elevator hoist motor 12, primary power supply 20, and ES system 32 based on a target storage state. In this example, ES system 32 stores electrical energy, and the storage state is a state-of-charge (SOC). A predicted usage pattern is first established based on forecast hoist motor demand (step 70), which may include past or predicted demand, or the combination of both. Hoist motor operation module 64 monitors usage characteristics of elevator hoist motor 12 and stores data related to these usage characteristics in data storage module 62. In some embodiments, the usage characteristics include the time between each run of elevator hoist motor 12 and power demand of each of the runs. The usage characteristics may also include information such as the number of passengers transported during each run, the load in elevator car 40 (as measured by load sensor 46) during each run, and the duration of each run. Building schedules may also be considered as a part of developing the predicted usage pattern. The data in data storage module 62 is provided to processor 60, which analyzes the usage characteristics to determine usage patterns. In some embodiments, processor 62 employs sequential data analysis on the data, in which the data is analyzed for patterns as it is stored in data storage module 62. Processor 62 may update the predicted usage pattern after each elevator run to assure the pattern is based on as many data points as possible.

Processor 60 then sets a target SOC for ES system 32 based on the predicted usage pattern (step 72). In particular, for each point in the predicted usage pattern, a target SOC is established that maximizes the amount of energy stored in ES system 32 while keeping primary power supply 20 below current and voltage limits and maintaining ES system 32 within storage capacity limits. To set the target SOC for ES system 30 at a given time, processor 60 monitors current usage characteristics of elevator 14 and correlates these usage characteristics to the predicted usage pattern. When the current usage state with respect to the predicted usage pattern is established, the target SOC for the current usage state is set.

By determining the current usage state of elevator 14 with respect to the predicted usage pattern, processor 60 can predict future energy demands and adjust the target SOC of ES system 32 accordingly.

By observing power limits on primary power supply 20, the overall power demand on primary power supply 20 is reduced, which permits a reduction in the size of components that deliver power from primary power supply 20 to power system 10. In addition, when the SOC of ES system 32 is maintained at about the target SOC, the longevity of ES system 32 may be prolonged by controlling the swing charge limits of ES system 32. While establishing usage patterns and setting the target SOC are done by processor 60 of drive controller 36 in the embodiment described, these functions may also be performed by the processor that controls dispatching of elevator 14 or by a separate dedicated processor connected to drive controller 36.

As an example, the predicted usage pattern may indicate that during morning hours on Monday through Friday, a large number of passengers ride elevators up to their floors, and elevators return generally empty to the main floor. During that time period, it is expected that there will be positive demand by the elevator motor for power, and relatively low regeneration (negative demand) occurring. In that period the target SOC may be higher so that both regeneration and grid supplied power (during idle times) is used to charge ES 32. By counting the number of passengers that have traveled up and comparing to a predicted pattern of passengers, a more accurate setting of target SOC can be made then is only time of day were used. If the SOC target results in currents higher that the design limits, the dispatcher can adjust the times at elevator stops position to allow for lower levels of currents while meeting the SOC requirements.

In the late afternoon of Monday through Friday in this example, most passengers will be riding down to the main floor, and relatively few will be riding up. Therefore, it is expected that more regeneration (negative demand) than positive demand will occur. During that time period, the target SOC can be reduced because there will be less need to charge ES system 32 during idle periods. Most recharging can be provided by regeneration.

Drive controller 36 controls power exchanged between hoist motor 12, primary power supply 20, and ES system 32 to address the power demand of hoist motor 12 and maintain the SOC of ES system 32 at about the target SOC (step 74). Voltage regulator 30 (FIG. 1) establishes the power demand of elevator hoist motor 12 and provides a signal related to this demand to drive controller 36. When the power demand of hoist motor 12 is positive, power is supplied to hoist motor 12 at least partially from the ES system 32 while the SOC of the ES system is at or above the target SOC. The proportion of the power supplied by ES system 32 may also be a function of the proximity of the SOC to the target SOC. More particularly, as the SOC of ES system 32 approaches the target SOC, a smaller portion of power may be supplied by ES system 32 to hoist motor 12. Drive controller 36 controls regenerative drive 29 and ES system controller 34 to provide power to hoist motor 12 in the appropriate ratio.

When the power demand of hoist motor 12 is negative, regenerated power from hoist motor 12 may be delivered to ES system 32 while the SOC of ES system 32 is below the target SOC. When the SOC of ES system 32 is at or above the target SOC during periods of negative hoist motor power demand, the regenerated power from hoist motor 12 may be delivered to primary power supply 20. The proportion of the power delivered from hoist motor 12 to ES system 32 during periods of negative power demand may also be a function of the proximity of the SOC to the target SOC, and offer design trade-offs between system life-time and energy efficiency targets. Drive controller 36 controls regenerative drive 29 and ES system controller 34 to deliver power from hoist motor 12 to power supply 20 and ES system 32 in the appropriate ratio.

When the power demand of hoist motor 12 is approximately zero, processor 60 may control regenerative drive 29 and ES system control 34 to deliver power from primary power supply 20 to ES system 32 while the SOC of ES system 32 is below the target SOC. This recharges ES system 32 to about the target SOC, which assures expected power demand of hoist motor 12 (based on the predicted usage pattern) is addressed efficiently.

By keeping the SOC of ES system 32 at about the target SOC, ES system 32 can also address the power demand of hoist motor 12 in the event of a failure of primary power supply 20. The target SOC is set such that power can be delivered to ES system 32 when hoist motor 12 is regenerating power without needing to dissipate any of the energy. In addition, the target SOC is high enough to allow for extended positive power demand operation of hoist motor 12 after failure of primary power supply 20.

During a failure of primary power supply 20, ES system 32 addresses the power demand for hoist motor 12. Thus, if power demand for hoist motor 12 is positive, ES system 32 supplies that demand, and if power demand for hoist motor 12 is negative, ES system 32 stores power regenerated by hoist motor 12. ES system 32 may be controlled to address hoist motor power demand as a function of the SOC of ES system 32 and only while the SOC of ES system 32 is within a certain range.

In summary the present invention relates to managing power in an elevator system including an elevator hoist motor, a primary power supply, and an electrical energy storage (ES) system. A predicted usage pattern for the hoist motor is established based on past hoist motor power demand. A target storage state (e.g., SOC) for the ES system is then set based on the predicted usage pattern. Power exchanged between the hoist motor, the primary power supply, and the ES system is controlled to address power demand of the hoist motor and to maintain the storage state of the ES system at about the target storage state. By controlling the storage state of the ES system based on past traffic and power demand patterns, the energy stored in ES system can be maximized while remaining within constraints of peak power drawn from the primary power supply and storage limits for the ES system, and minimizing the need to dissipate regenerated power. In addition, when the storage state of the ES system is maintained at about the target storage state, the longevity of the ES system may be prolonged by controlling the swing charge limits of the ES system.

Although the present invention has been described with reference to preferred embodiments, workers skilled in the art will recognize that changes may be made in form and detail without departing from the spirit and scope of the invention.

The invention claimed is:

1. A method for managing power distribution in an elevator system including an elevator hoist motor, a primary power supply, and an energy storage system, the method comprising:

establishing a predicted usage pattern based at least in part on historical hoist motor demand data;

setting a target storage state for the energy storage system based on the predicted usage pattern; and controlling power exchanged between the hoist motor, the primary power supply, and the energy storage system to address power demand of the hoist motor and to maintain the storage state of the energy storage system at about the target storage state.

2. The method of claim 1, wherein establishing a predicted usage pattern comprises:

storing elevator run data including time between runs and power demand of each of the runs; and analyzing the elevator run data to determine a pattern of usage.

3. The method of claim 2, wherein analyzing the elevator run data comprises conducting a sequential analysis of the elevator run data.

4. The method of claim 1, wherein the controlling step comprises:

addressing hoist motor power demand with the energy storage system in a proportion that is a function of a proximity of the storage state of the energy storage system to the target storage state.

5. The method of claim 1, wherein, when power demand of the hoist motor is negative, the controlling step comprises:

delivering regenerated power from the hoist motor to the energy storage system while the storage state of the energy storage system is below the target storage state; and delivering regenerated power from the hoist motor to the primary power supply while the storage state of the energy storage system is at or above the target storage state.

6. The method of claim 1, wherein, when power demand of the hoist motor is approximately zero, the controlling step comprises:

delivering power from the primary power supply to the energy storage system while the storage state of the energy storage system is below the target storage state.

7. The method of claim 1, wherein, when power demand of the hoist motor is positive, the controlling step comprises:

supplying power to the hoist motor at least partially from the energy storage system while the storage state of the energy storage system is at or above the target storage state.

8. The method of claim 1, wherein the predicted usage pattern is based in part on a predicted building schedule.

9. A method for addressing power demand of an hoist motor with a primary power supply and an energy storage system, the method comprising:

monitoring usage characteristics related to the hoist motor demand;

correlating the usage characteristics with a stored pattern of usage based at least in part on historical hoist motor data;

setting a target storage state for the energy storage system based on the usage characteristics and the pattern of usage; and controlling power exchanged between the hoist motor, the primary power supply, and the energy storage system to address power demand of the hoist motor and to maintain the storage state of the energy storage system at about the target storage state.

10. The method of claim 9, wherein the usage characteristics include time between runs of the hoist motor and power demand of each of the runs.

11. The method of claim 9, wherein the controlling step comprises:

addressing hoist motor power demand with the energy storage system in a proportion that is a function of a proximity of the storage state of the energy storage system to the target storage state.

12. The method of claim 9, wherein, when power demand of the hoist motor is negative, the controlling step comprises:

delivering regenerated power from the hoist motor to the energy storage system while the storage state of the energy storage system is below the target storage state; and delivering regenerated power from the hoist motor to the primary power supply while the storage state of the energy storage system is at or above the target storage state.

13. The method of claim 9, wherein, when power demand of the hoist motor is approximately zero, the controlling step comprises:

delivering power from the primary power supply to the energy storage system while the storage state of the energy storage system is below the target storage state.

14. The method of claim 9, wherein, when power demand of the hoist motor is positive, the controlling step comprises:

supplying power to the hoist motor at least partially from the energy storage system while the storage state of the energy storage system is at or above the target storage state.

15. The method of claim 9, and further comprising:

updating the pattern of usage after a hoist motor run.

16. An elevator system comprising:

an elevator hoist motor operable to control movement of an elevator car;

an elevator power system connected to the elevator hoist motor an operable to address power demand of the elevator hoist motor, the elevator power system connected to receive power from a primary power supply and including an energy storage system; and a controller operable to set a target storage state for the energy storage system based on current usage characteristics and a predicted usage pattern of the elevator hoist motor based on historical hoist motor data, wherein the controller is further operable to control power exchanged between the hoist motor, the primary power supply, and the energy storage system to address power demand of the hoist motor and to maintain the storage state of the energy storage system at about the target storage state.

17. The elevator system of claim 16, wherein the controller addresses hoist motor power demand with the energy storage system in a proportion that is a function of a proximity of the storage state of the energy storage system to the target storage state.

18. The elevator system of claim 16, wherein the controller stores elevator run data including time between runs of the hoist motor and power demand of each of the runs and analyzes the elevator run data to determine a pattern of usage.

19. The elevator system of claim 16, wherein the controller updates the predicted usage pattern after a hoist motor run.

20. The elevator system of claim 16, wherein the current usage characteristics include time between runs of the hoist motor and power demand of each of the runs.

* * * * *